US005451093A

United States Patent [19]

Petrie et al.

[11] Patent Number: 5,451,093

[45] Date of Patent: Sep. 19, 1995

[54] SPRING-MOUNTED INFANT SEAT

[75] Inventors: Aiden J. Petrie; John G. Matthews; Stephen E. Lane, all of Providence, R.I.

[73] Assignee: Item New Product Development, Inc., Providence, R.I.

[21] Appl. No.: 212,070

[22] Filed: Mar. 11, 1994

[51] Int. Cl.[6] ..... A47D 1/00

[52] U.S. Cl. ..... 297/137; 248/618; 297/314; 297/282; 297/344.26; 482/66

[58] Field of Search ..... 297/5, 136, 137, 273, 297/314, 281, 344.21, 344.26, 282; 248/143, 372.1, 618; 280/87.051; 135/68, 73, 82; 482/66, 68, 69

[56] References Cited

U.S. PATENT DOCUMENTS

| | | | |
|---|---|---|---|
| 8,478 | 10/1851 | Rice | 297/136 |
| 432,378 | 7/1890 | Davidson et al. | 297/5 |
| 517,403 | 3/1894 | Bradish et al. | 297/136 X |
| 1,326,921 | 1/1920 | Dzimitowicz | 297/136 X |
| 1,688,922 | 2/1927 | Drinosky, Jr. . | |
| 2,454,599 | 11/1946 | Dunson . | |
| 2,631,651 | 3/1949 | Boysel . | |
| 2,738,245 | 5/1954 | Campbell . | |
| 2,812,012 | 9/1954 | Hansburg . | |
| 2,910,111 | 10/1959 | Hansburg | 297/137 |
| 3,874,690 | 8/1973 | Marrone | 280/47.39 |
| 4,025,083 | 9/1975 | Saint | 280/87.02 |
| 4,743,008 | 5/1988 | Fermaglich et al. | 297/137 X |
| 4,971,392 | 10/1988 | Young | 248/418 |
| 5,078,451 | 8/1990 | Sobel . | |

FOREIGN PATENT DOCUMENTS

| | | | |
|---|---|---|---|
| 1031183 | 6/1953 | France | 297/5 |
| 2801467 | 7/1978 | Germany | 297/136 |

*Primary Examiner*—Peter R. Brown
*Attorney, Agent, or Firm*—John E. Reilly

[57] ABSTRACT

An infant seat unit includes a seat or harness disposed on a table, the table being resiliently mounted on a base unit at spaced circumferential intervals displaced away from the seat itself so that the seat and table are free to bounce up and down with respect to the base, and the seat also can be made to be rotatable with respect to the base.

29 Claims, 4 Drawing Sheets

SPRING-MOUNTED INFANT SEAT

SPECIFICATION

This invention relates to infant seats; and more particularly relates to a novel and improved combination infant seat and tray adapted for use as an activity and exercise center for a young child.

BACKGROUND AND FIELD OF INVENTION

Numerous types of seats have been devised for infants in the pre-ambulatory stage who are either just learning to crawl or walk. Most desirably, the young child can be placed in the chair with his or her feet just touching the ground and have some freedom of movement in turning or bouncing in the chair but nevertheless can be safely left unattended for at least limited periods of time. In the past, baby walkers have been devised in which the seat itself is elastically suspended within a ring, the ring being rotatable and mounted on wheels, such as, disclosed in U.S. Pat. No. 1,688,922 to J. Drinosky, Jr. U.S. Pat. No. 3,874,690 to B. S. Marrone discloses a baby stroller in which the seat is rotatably mounted on a wheeled base, and U.S. Pat. No. 2,812,012 to G. B. Hansburg is directed to a combination chair and table unit in which the seat portion itself is rotatable. Other representative patents are U.S. Letters Pat. Nos. 2,454,599 to W. M. Dunson, 2,631,651 to E. J. Boysel, 2,738,245 to W. H. Campbell, 4,025,083 to D. Saint, 4,971,392 to Q. Young and 5,078,451 to D. J. Sobel.

There is a need for a combination infant seat and tray unit which is resiliently mounted on a base with the spring suspension elements displaced from the seat portion itself and in such a way as to enable tilting or bouncing by the infant without danger of tipping the entire unit; and further wherein the seat is rotatable with respect to the rest of the unit. It is also desirable that the unit be stationary and not of the walker type but have sturdy legs on the unit which can be folded into a compact storage condition.

SUMMARY OF INVENTION

It is therefore an object of the present invention to provide for a novel and improved infant seat which is capable of serving as an exercise and activity center for young children.

It is another object of the present invention to provide for a novel and improved combination seat and tray unit which is so constructed and arranged as to be capable of undergoing rotation and bouncing.

It is a further object of the present invention to provide in an infant seat for a novel and improved spring suspension unit alone or in combination with a rotatable seat portion so that the child is free to turn in different directions as well as to tilt or bounce without danger of capsizing the unit.

In accordance with the present invention, an infant seat unit has been devised which comprises a base having an upper annular portion, a seat support of generally annular configuration superimposed upon the annular portion, a seat disposed within a common opening through the seat support and annular portion, and resilient suspension means disposed between the seat support and base whereby the seat and the seat support are capable of undergoing vertical reciprocating movement with respect to the base. Preferably, the base has downwardly extending legs which make direct engagement with the floor or other ground surface and therefore cannot be advanced by the child.

An additional feature of the invention is to permit rotation of the seat relative to the base so that the child can turn in different directions, and the resilient suspension means is displaced from the seat portion itself so that the child is able to tilt or bounce the entire seat support section without danger of tipping over or falling from the unit; and further is designed such that by placing the spring suspension elements away from the seat greatly minimize any possibility of pinching or hurting the child.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
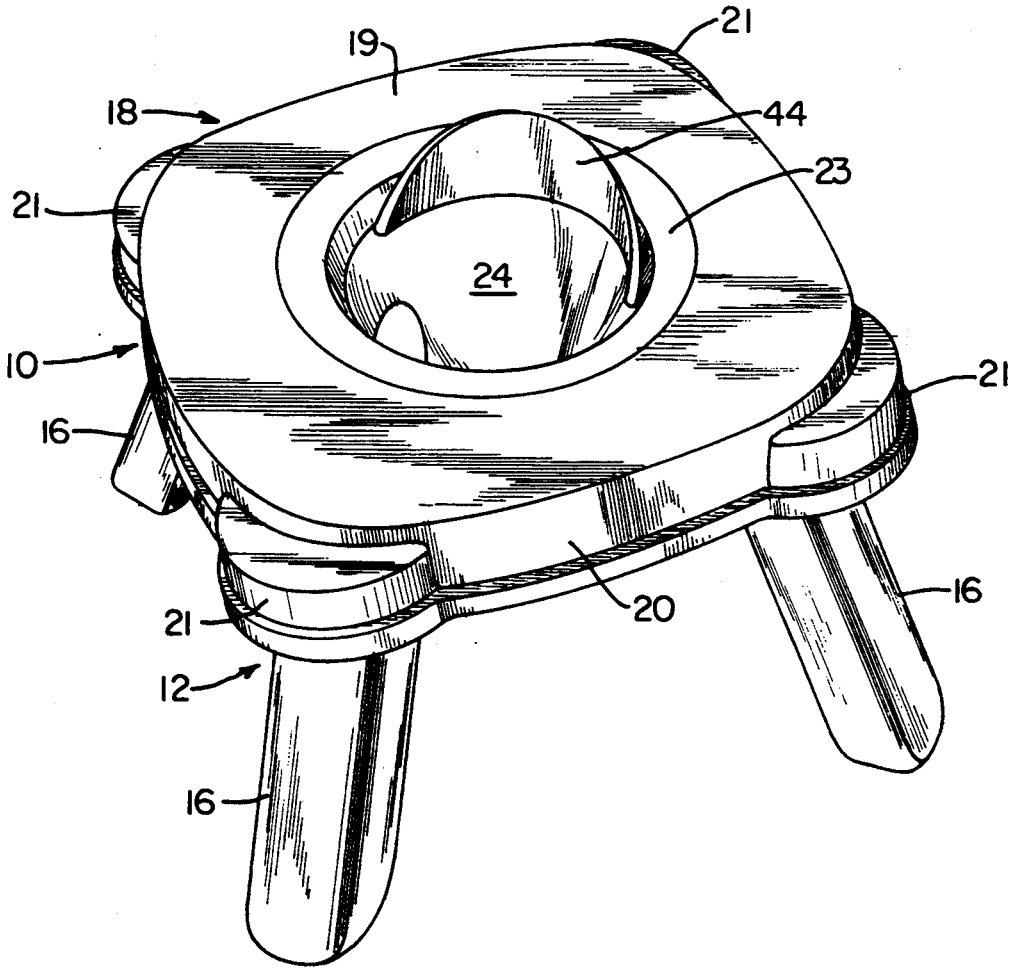
FIG. 1 is a perspective view of a preferred form of infant seat unit in accordance with the present invention.

Referring in more detail to the drawings, a preferred form of infant seat 10 is broadly comprised of a base unit 12 including an upper ring or annular portion 14 with a central opening 15, and foldable legs 16 extend downwardly at spaced circumferential intervals from the annular portion 14. An annular seat support 18 is of inverted, generally cup-shaped configuration with a top or table surface 19 and outer peripheral wall 20 having radially outwardly protruding, arcuate housing portions 21 which are aligned with the leg sections 16 so as to be spaced outwardly of the upper ends of the leg sections 16 when the seat support 18 is disposed over the annular portion 14. An infant support 22 includes an annular cover portion 23, a seat or harness 24, and an outer circular rim 25 which is supported on its outer edge on an inner circumferential edge 26 of the seat support 18 and surrounds a central opening 27.

Figure 2:
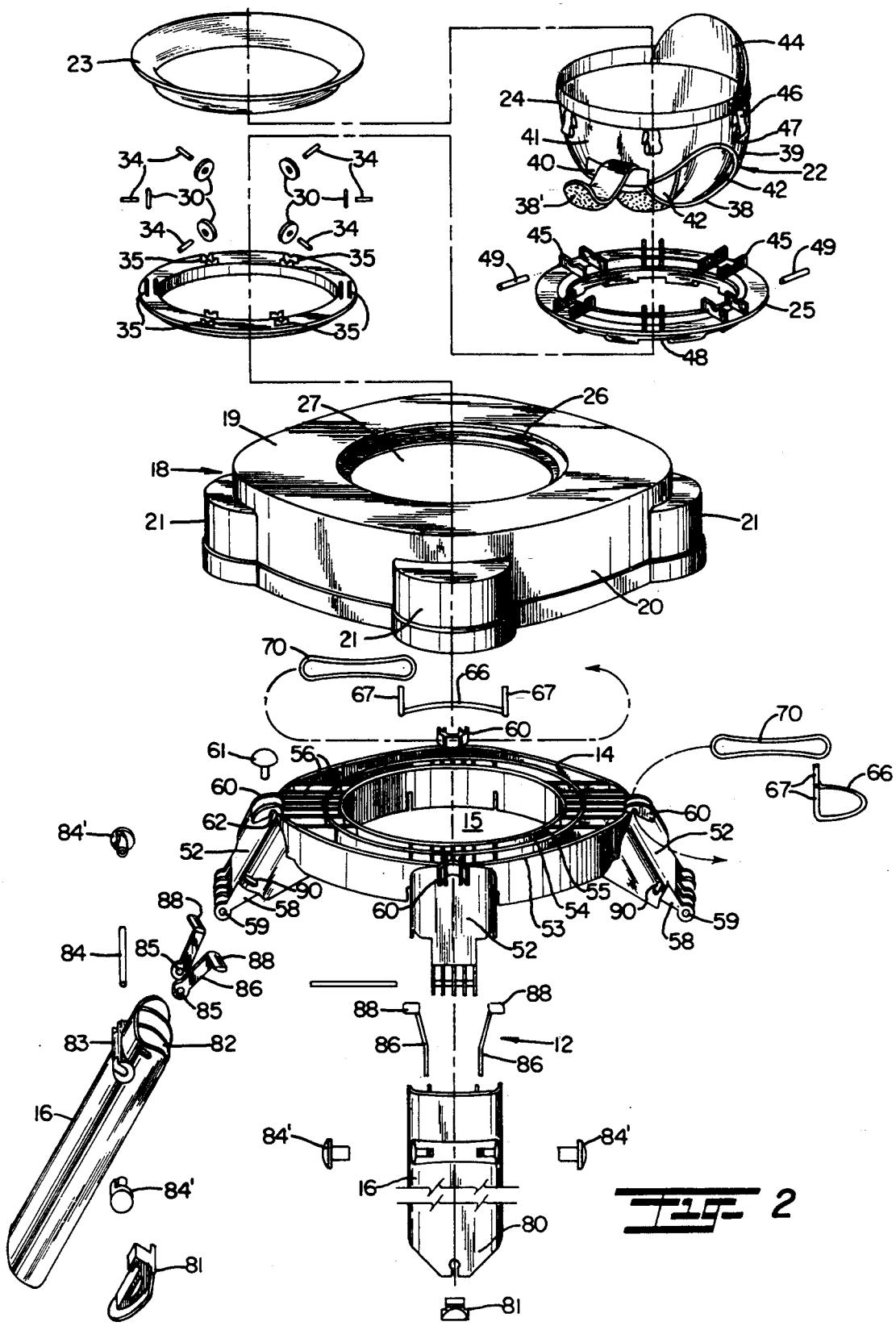
FIG. 2 is an exploded view of the preferred form of invention shown in FIG. 1.
Figure 5:
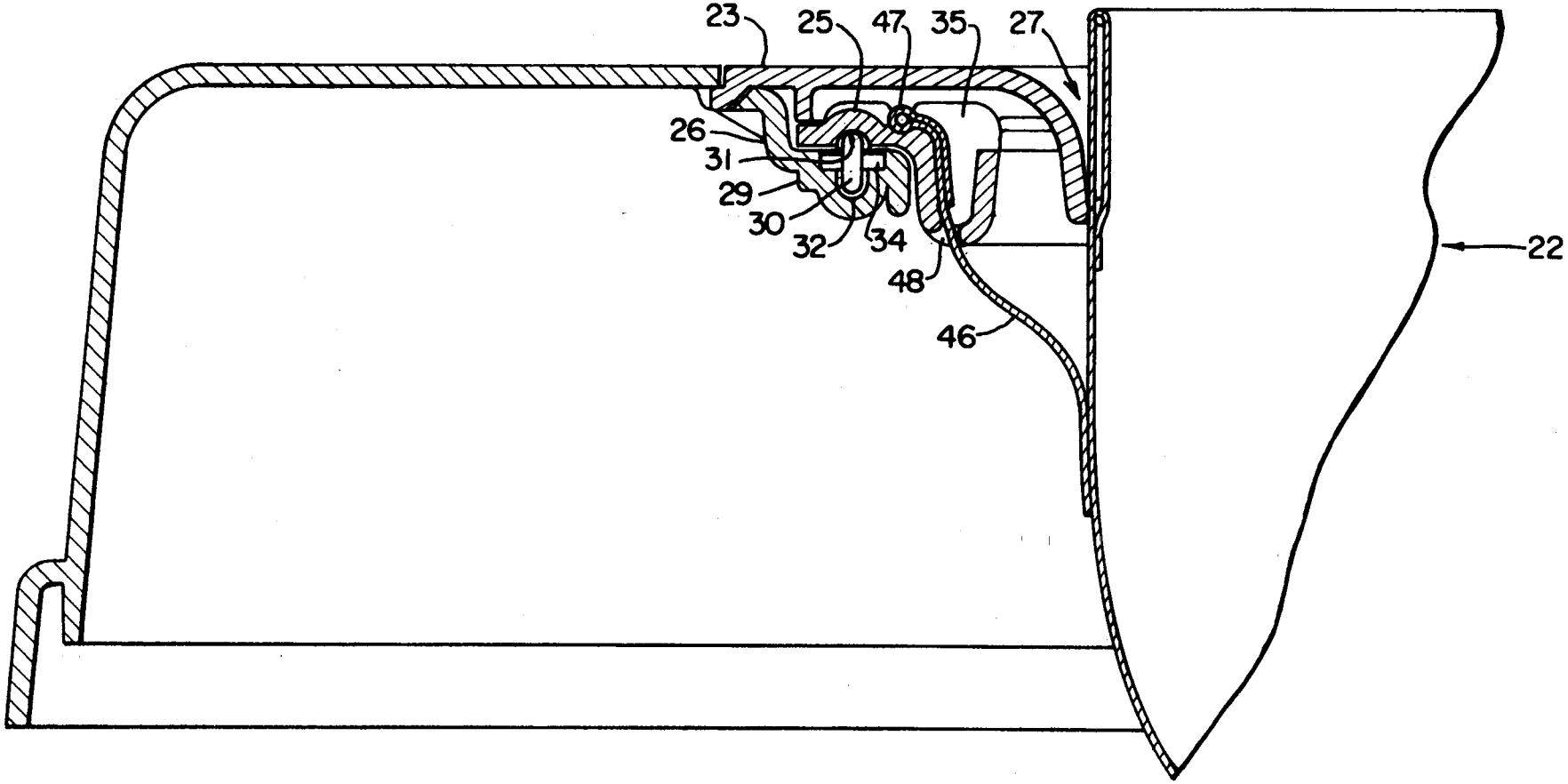
FIG. 5 is an enlarged sectional view illustrating the suspension of the seat with respect to the seat support unit in the preferred form of invention.

In order to permit the infant support unit 22 to rotate with respect to the seat support unit 18 and base 12, a series of bearing members preferably take the form of rollers 30 which are disposed between confronting grooves 31 and 32 of the rim 25 and bearing support ring 29, respectively, as best seen from FIGS. 2 and 5. Each roller is journaled on a shaft 34 which is mounted at opposite ends in bearing supports 35 on opposite sides of the lower groove 32 in the ring 29 thereby to support the rollers 30 such that only the upper groove 31 engages the roller and permits the entire infant support unit including the seat 24 and rim 25 to rotate freely with respect to the seat support 18. The cover 23 is removably seated on a downwardly offset slotted portion 19′ in the edge 26 of the table surface 19 so that the child cannot gain access to the rotating elements beneath the cover 23.

The preferred form of seat 24 is of generally bowl-shaped configuration and extends downwardly through the openings 27 and 15 in the seat support 18 and base 12. The seat 24 is composed of a soft, flexible material, such as, fabric with a central crotch strap 38 extending from lower rounded rearward surface portion 39 and passing through a limited opening or slit 40 in the front wall surface 41 of the seat. The crotch strap 38 has complementary hook-and-loop fastener surfaces on spaced portions of free end 38′ of the strap so that when the free end is doubled upon itself will releasably but securely retain the strap in connected relation to the front surface 41. Leg openings 42 are thereby formed on opposite sides of the crotch strap so that the infant may be positioned in the seat with the legs freely extending downwardly through the leg openings 42. The crotch strap 38 enables adjustment of the effective height of the seat so that the infant's feet can comfortably reach the floor. A backrest 44 may suitably be provided and which extends upwardly from the seat along a limited circumferential portion above the rearward surface portion 39.

The seat 24 is suspended from the rim 25 by a series of circumferentially spaced straps 46 having looped ends 47 which extend upwardly through aligned, circumferentially spaced slots 48 in the rim 25. The straps 46 are retained by pins 49 inserted through the looped ends 47, as shown in FIGS. 2 and 5, the pins 49 being mounted on upstanding supports 45 on the upper surface of the rim 25. The upper surface 19 of the seat support unit 18 preferably defines an activity table including a tray area and various toys, not shown, to occupy the child when seated in the unit.

Figure 3:
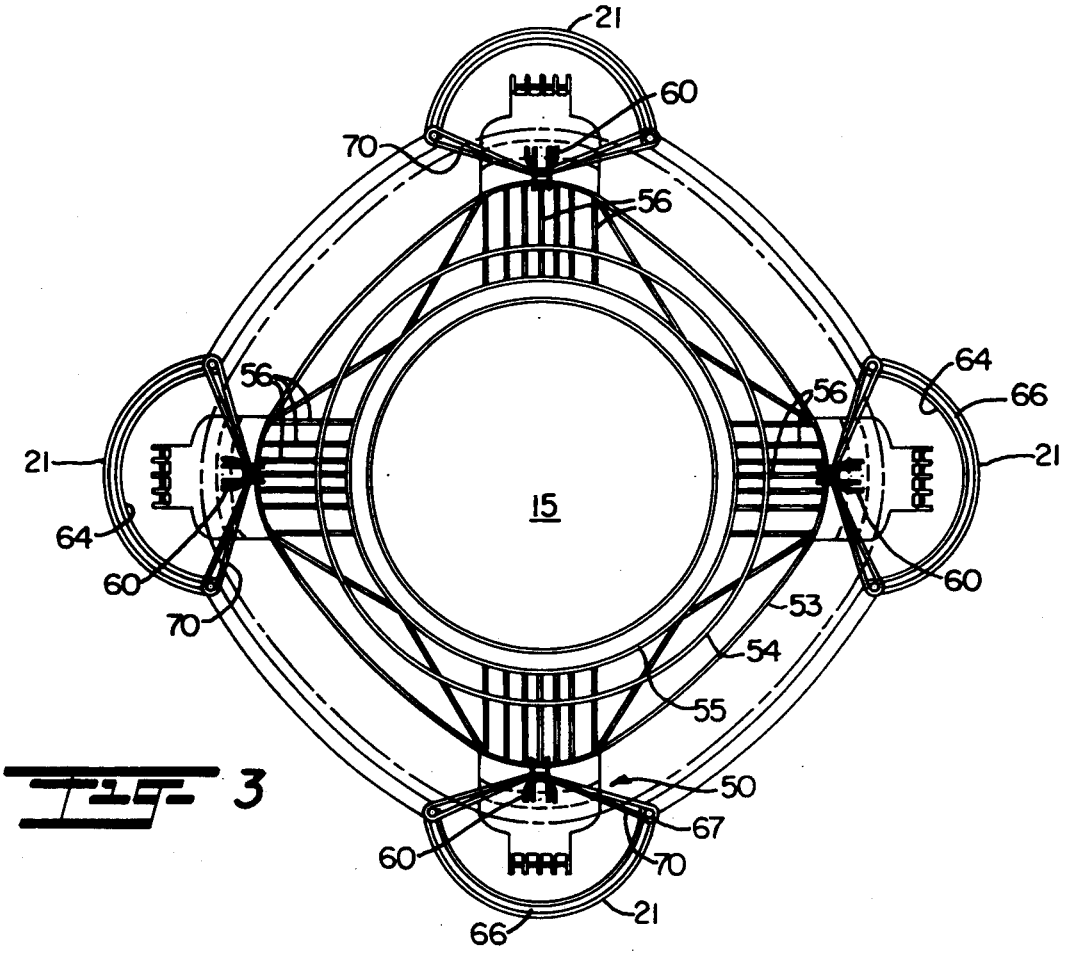
FIG. 3 is a top plan view of the base portion of the preferred form of seat unit.
Figure 4:
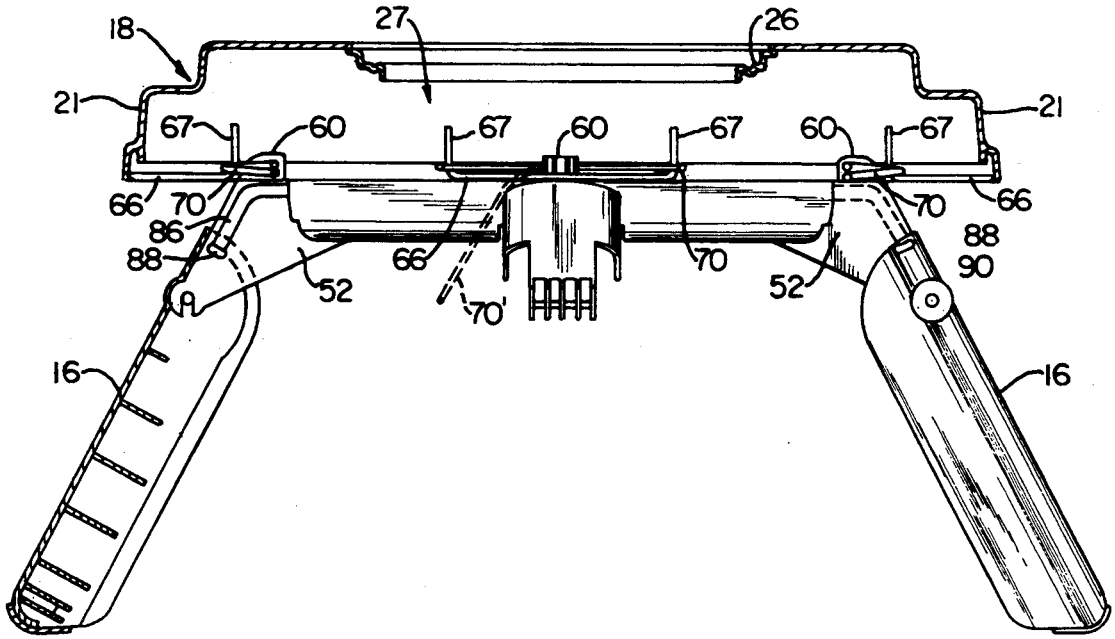
FIG. 4 is a front view in elevation with portions exposed to illustrate the mounting and movement of the spring suspension elements of the preferred form of invention.

An important feature of the present invention resides in the utilization of resilient suspension means 50 arranged at spaced circumferential intervals between the seat support 18 and the upper annular portion 14 of the base in order for the seat 24 and the seat support 18 to undergo bouncing or vertical reciprocating movement with respect to the base 16. Preliminary to describing the resilient suspension means 50 as shown in FIG. 3, it will be noted that the upper annular portion 14 of the base is made up of a series of spaced concentric rings 53, 54 and 55 interconnected by generally radially extending braces 56 at spaced circumferential intervals. As illustrated in FIGS. 3 and 4, a series of upper leg supports 52 are arranged at corresponding intervals to the brace members 56 to angle outwardly and downwardly from the outer peripheral ring or wall 53 of the annular portion 14 and terminate in downwardly convergent, closely spaced fingers 58 having aligned openings 59 through lower free ends of the fingers 58 for hinged connection of the leg portions 16 in a manner to be described.

An upstanding spring retainer 60 is disposed on each leg support 52 and is provided with a bumper or stop 61 and a closed slot or recess 62. The arcuate or rounded housing portions 21 of the seat support unit are hollow, each with an inner wall surface provided with a ledge 64 and bosses 65 at opposite ends of each ledge. A spring support clip includes an arcuate portion 66 and posts 67 at opposite ends of the arcuate portion which are dimensioned to fit within each housing 21 with the arcuate portion 66 resting upon the ledge 64 and the posts 67 inserted into the bosses 65. The housings 21 are resiliently mounted with respect to the annular portion 14 by spring members in the form of endless rubber bands 70, each band 70 being inserted through a recess 62 on the upper surface of each leg support, and opposite ends of the band are passed over the posts 67 of each clip prior to insertion of the posts 67 into the bosses 65. Once assembled, the spring members or bands 70 will assume the configuration illustrated in FIGS. 3 and 4 in which the bands 70 are stretched over the posts 67 and are free to undergo vertical reciprocal movement between a substantially horizontal attitude and a downwardly inclined attitude as illustrated in dotted lines at 70′ of FIG. 4.

It will be appreciated that the resilient suspension means 50 may assume different forms and, for example, may be comprised of metallic or rubber or rubber-like spring elements between the upper seat support unit 18 and the base 12. For example, either coiled or leaf springs may be interposed between the seat support 18 and base 12. Similarly, the spring 70 may assume different configurations and be composed of different materials, such as, an elastic cord commonly referred to as a "bungee" cord.

Each of the legs 16 is preferably in the form of a hollow tube of generally rectangular cross-section with a lower beveled end or foot 80 provided with a frictional insert 81. The upper end of the leg 16 is slotted as at 82 for insertion of the fingers 58 on the leg support, and a hollow generally cylindrical keeper 83 is disposed in the upper wall of the leg 16. A hinged relationship is established between the leg 16 and upper leg support 52 by inserting pivot pin 84 through the keeper 83 and the aligned openings 59 of the fingers 58 as well as through aligned openings 85 of leg lock members 86. End caps 84′ retain the pin 84 within the keeper 83. Each of the leg lock members 86 terminates in a laterally projecting locking tab 88 at its upper end which when inserted into the hollow leg support 52 will advance into alignment with slots 90 in opposite sidewalls of the leg support and may be manually advanced into locking engagement with the slots 90 so as to normally prevent pivotal or folding movement of the leg 16 with respect to the leg supports. When the tabs 88 are depressed in order to clear the slots 90, the legs 16 are then freely pivotal about the leg support 52 and foldable into an inner collapsed position against the underside of the annular portion 14.

It will be appreciated from the foregoing that a combination infant seat and tray or table unit has been devised in which the resilient suspension between the seat support portion and base is displaced radially and outwardly away from the seat itself and in such a way as to enable tilting or bouncing by the infant without danger of tipping the entire unit. In the preferred form, the seat is rotatable both with respect to the seat support and base, although it will be apparent that the seat may be non-rotatable, or that other means of rotation may be employed which are not located between the seat and seat support unit. Furthermore, in the preferred form, the base unit and particularly the leg members 16 are used in place of a wheeled base so that the child is not able to advance along the floor and therefore move too close to dangerous areas, such as, stairways, hot stoves and the like. Of course, the resilient suspension system of the present invention could also be utilized with a wheeled unit but preferably one of the type in which the wheels can be locked when desired.

It is therefore to be understood that while a preferred form of invention is herein set forth and described, the above and other modifications may be made in the construction and arrangement of elements comprising the invention without departing from the spirit and scope thereof as defined by the appended claims and reasonable equivalents thereof.

We claim:

1. An infant seat unit comprising:

a base having an upper annular portion;

a seat support of generally annular configuration superimposed on said upper annular portion of said base;

a seat members mounted to said seat support and disposed within a common opening through said seat support and said upper annular portion; and resilient suspension means normally extending substantially horizontally in an unstressed state between said seat support and said base for allowing said seat member and said seat support to undergo bath tilting and vertical reciprocating movement with respect to said base.

2. An infant seat unit according to claim 1, said base having spaced leg members extending downwardly from said upper annular portion.

3. An infant seat unit according to claim 2, wherein said legs are foldable between a position extending downwardly from said upper annular portion and a retracted position beneath said upper annular portion.

4. An infant seat unit according to claim 1, wherein said seat member includes rotating means whereby said seat member is rotatable relative to said base.

5. An infant seat unit according to claim 4, wherein said rotating means includes bearing members between said seat and said upper annular portion.

6. An infant seat unit according to claim 4, wherein said seat support includes an inner circumferential edge defining said opening through which said seat extends, and said seat includes an outer peripheral, annular rim superimposed on said inner circumferential edge, and said rotating means is interposed between said annular rim and said circumferential edge.

7. An infant seat unit according to claim 6, said rotating means including circumferentially spaced rollers disposed between complementary grooves in said annular rim and said circumferential edge.

8. An infant seat unit according to claim 7, said seat member including an infant support portion of generally cup-shaped configuration extending downwardly from said annular rim through said common opening and provided with spaced leg openings therein.

9. An infant seat unit according to claim 8, said infant support portion including means for adjusting the height of an infant placed therein with respect to a surface upon which said base rests.

10. An infant seat unit according to claim 9, said adjustment means defined by an adjustable crotch strap extending between said leg openings.

11. An infant seat unit according to claim 8, said seat including suspension straps at circumferentially spaced intervals between said infant support portion and said rim.

12. An infant seat unit according to claim 11, wherein said resilient suspension means is defined by circumferentially spaced spring members between said seat support and said annular portion.

13. An infant seat unit according to claim 12, wherein said spring members are each defined by a bungee cord, each said cord having an intermediate portion anchored to said annular portion and opposite ends anchored to said seat support.

14. An infant seat unit according to claim 1, said seat support being of inverted, generally cup-shaped configuration including an outer peripheral wall extending downwardly in outer spaced circumferential relation to said annular portion, and said resilient suspension means being in the form of circumferentially spaced spring members between said outer peripheral wall and said annular portion.

15. An infant seat unit according to claim 14, wherein said spring members are defined by elastic cords, each of said cords having an intermediate portion anchored to said annular portion and opposite ends anchored to said seat support.

16. An infant seat unit according to claim 15, wherein each of said elastic cords is in the form of an endless loop with opposite ends thereof defining said opposite ends of said elastic cord, and pin members on said seat support extending through said opposite ends of said elastic cord.

17. An infant seat unit comprising:

a base having an upper annular portion and spaced leg members extending downwardly from said upper annular portion;

a seat support of generally annular configuration superimposed on said upper annular portion of said base;

a seat disposed within a common opening through said seat support and said upper annular portion and attached to said seat support;

bearing means disposed between said seat and said seat support for supporting said seat for rotation with respect to said seat support and said base; and resilient suspension means interposed for extension between said seat support and said upper annular portion whereby said seat and said seat support are capable of undergoing tilting and vertical reciprocating movement with respect to said base.

18. An infant seat unit according to claim 17, wherein said legs are foldable between a position extending downwardly from said upper annular portion and a retracted position beneath said upper annular portion.

19. An infant seat unit according to claim 17, wherein said seat support includes an inner circumferential edge defining said opening through which said seat extends, and said seat includes an outer peripheral, annular rim superimposed on said inner circumferential edge.

20. An infant seat unit according to claim 17, said bearing means including circumferentially spaced rollers disposed between complementary grooves in said annular rim and said circumferential edge.

21. An infant seat unit according to claim 20, said seat including an infant support portion of generally cup-shaped configuration extending downwardly from said annular rim through said common opening and provided with spaced leg openings therein.

22. An infant seat unit according to claim 21, said infant support portion including means for adjusting the height of an infant placed therein with respect to a surface upon which said base rests.

23. An infant seat unit according to claim 22, said adjustment means defined by an adjustable crotch strap extending between said leg openings, and said seat including suspension straps at circumferentially spaced intervals between said infant support portion and said rim.

24. An infant seat unit according to claim 17, wherein said resilient suspension means is defined by circumferentially spaced spring members between said seat support and said annular portion.

25. An infant seat unit according to claim 24, wherein said spring members are each defined by a bungee cord, each said cord having an intermediate portion anchored to said annular portion and opposite ends anchored to said seat support.

26. An infant seat unit according to claim 17, said seat support being of inverted, generally cup-shaped configuration including an outer peripheral wall extending downwardly in outer spaced circumferential relation to said annular portion, and said resilient suspension means being in the form of circumferentially spaced spring members between said outer peripheral wall and said annular portion.

27. An infant seat unit according to claim 26, wherein said spring members are defined by elastic cords, each of said cords having an intermediate portion anchored to said annular portion and opposite ends anchored to said seat support.

28. An infant seat unit according to claim 27, wherein each of said elastic cords is in the form of an endless loop with opposite ends thereof defining said opposite ends of said elastic cord, and pin members on said seat support extending through said opposite ends of said elastic cord.

29. An infant seat unit comprising:

a base having an upper annular portion;

a seat support of generally annular configuration superimposed on said upper annular portion of said base, said seat support being of inverted, generally cup-shaped configuration including an outer peripheral wall extending downwardly in outer spaced circumferential relation to said annular portion;

a seat member disposed within a common opening through said seat support and said upper annular portion; and resilient suspension means interposed between said seat support and said base in the form of circumferentially spaced elastic cords, each having an intermediate portion anchored to said annular portion and opposite ends anchored to said outer peripheral wall of said seat support whereby said seat and said seat support are capable of undergoing vertical reciprocating movement with respect to said base.

* * * * *